United States Patent [19]

Tomohiro et al.

[11] Patent Number: 4,893,990

[45] Date of Patent: Jan. 16, 1990

[54] MIXED FLOW IMPELLER

[75] Inventors: Teruhiko Tomohiro, Nara; Masahiro Atarashi, Kusatsu, both of Japan

[73] Assignee: Matsushita Electric Industrial Co., Ltd., Osaka, Japan

[21] Appl. No.: 253,861

[22] Filed: Oct. 5, 1988

[30] Foreign Application Priority Data

Oct. 7, 1987 [JP] Japan ..... 62-252877

[51] Int. Cl.[4] ..... F24F 11/04; F24F 11/02

[52] U.S. Cl. ..... 416/228; 416/237; 416/243; 416/223 R

[58] Field of Search ..... 416/228 R, 228 A, 237 R, 416/237 A, 4, 223 R, 243

[56] References Cited

U.S. PATENT DOCUMENTS

| | | | |
|---|---|---|---|
| 698,582 | 4/1902 | Strothman | 416/237 |
| 1,050,119 | 1/1913 | Flanders | 416/243 |
| 1,807,397 | 5/1931 | Fechheimer | 416/223 |
| 2,086,307 | 7/1937 | Stewart | 416/237 |
| 2,978,040 | 4/1961 | Wirkkala | 416/234 |
| 3,972,646 | 8/1976 | Brown et al. | 416/228 |

FOREIGN PATENT DOCUMENTS

| | | | |
|---|---|---|---|
| 844518 | 7/1949 | Fed. Rep. of Germany | 416/243 |
| 1137715 | 6/1957 | France | 416/4 |

*Primary Examiner*—Robert E. Garrett
*Assistant Examiner*—Hoang Nguyen
*Attorney, Agent, or Firm*—Wenderoth, Lind & Ponack

[57] ABSTRACT

The disclosure is directed to a mixed flow impeller with a low noise, to be used for a blower of an air conditioner or the like. The mixed flow impeller of the present invention is characterized in three points, i.e., thin thickness blade member increased in its thickness only at its leading edge, a plate-like triangular protrusion provided at an outer peripheral portion of the leading edge, and blade curvature line having its maximum curvature position deviated toward the trailing edge side through employment of a cubic curve. Since each of the above features may be caused to function independently, noise reduction is possible even if it is executed singly, but the maximum effect is available when the are effected in combination.

8 Claims, 9 Drawing Sheets

MIXED FLOW IMPELLER

BACKGROUND OF THE INVENTION

The present invention generally relates to an impeller or vane wheel and more particularly, to a mixed flow impeller for a blower which is widely employed in a domestic or industrial air conditioner, ventilating fan or the like.

In recent years, the mixed flow impeller has been broadly used for various products such as air blasting arrangements for air conditioning, heating appliances, and cooling of electronic equipment, ventilating fans, etc. However, noises produced by the mixed flow impeller as it rotates through air present a main problem related to these products, which are frequently used in places closely related to life environment, and reduction of noises has been strongly required recently, also from the aspect of elimination of public nuisance by noises with respect to the neighborhood.

Conventionally, as shown in FIGS. 1 and 2, a propeller fan having a simplified guide includes an impeller 3 constituted by a cylindrical hub 1 and a plurality of blades or vanes 2 each having a generally uniform thickness and secured to the outer peripheral portion of said hub 1, and a guide member 6 disposed around the peripheral portion of said impeller 3 so as to partition a suction section 4 from a delivery section 5 as illustrated.

Noises by such a fan as referred to above and arising from an aerodynamic cause may be broadly classified into the following two kinds, one of which is a discrete frequency noise showing a peak value at some frequencies to be determined by the number of blades and rotational speed, and the other of which is a broad-band frequency noise which shows a gentle spectrum distribution with respect to the frequency. The former noise is produced by interference between the blades and surrounding solid walls or periodical turbulence, while the latter noise is mainly attributable to variation in a lift resulting from discharge of turbulent vortex from the trailing edge of the blade or generation of blade tip vortex, etc.

In order to reduce such noises, various counter-measures have been proposed up to the present. In the arrangement as in the propeller fan described with reference to FIG. 2(*a*), an effect mainly for reducing the discrete frequency noise can be obtained by providing the blade face with a tilting angle $\theta$ in the rotating direction. Meanwhile, through employment of various blade profiles, for example, of NACA (National Advisory Committee for Aeronautics), it has been possible to suppress separation of air flow from the blade surface, thereby to reduce generation of turbulent noises, with a simultaneous improvement of air moving performance.

However, the tilting of the blade face in the rotating direction brings about inconveniences as described hereinbelow.

As important items for determining aerodynamic performance of an impeller, there may be raised an entrance angle $\beta 1$, and exit angle $\beta 2$ and a chord $L_C$, etc. as shown in FIG. 2(*b*). Now, it is assumed that the fundamental blade shape which satisfies the target performance has been determined as shown in FIG. 3. Here, on the supposition that the relation $\theta=\theta_0$ provides the optimum tilting angle for reducing noises, the blade shape may be designed as shown in FIG. 4 by tilting the blade face in FIG. 3 by $\theta_0$. Upon comparison of a cross section along the line Va-Va in FIG. 3 with that along the line Vb—Vb in FIG. 4, the blade of FIG. 4 shows the shape more inclined in the blasting direction as seen from FIG. 5. Such an inclination angle is determined by the tilting angle and the shape of the original impeller, and if this angle is altered, the air flow in a radial direction is affected, with consequent variation in the aerodynamic performance of the impeller. Corrections are required in order to prevent such a disadvantage, but this may undesirably complicate the designing of the impeller, thus extremely obstructing proper selection of aerodynamic performance and tilting angle at the optimum values.

Moreover, in the thin blade impeller made of sheet metal or the like, it is impossible to adopt the blade profiles of NACA, etc., and even in the case of blades made of resin, there are problems related to weight increase due to larger blade thickness, insufficient strength, cost increase, sinkage or cracking during molding, etc., and thus, blade profile impellers have not be employed except for a particular case.

SUMMARY OF THE INVENTION

Accordingly, an essential object of the present invention is to provide an improved mixed flow impeller which is capable of simultaneously realizing high aerodynamic performance and low noise irrespective of difference in the blade material such as sheet metal, resin, etc., through an attempt for noise reduction without complicating the aerodynamic performance of the impeller.

Another object of the present invention is to provide a mixed flow impeller of the above described type which is simple in construction and stable in functioning, and can be readily manufactured at low cost.

In accomplishing these and other objects, according to one aspect of the present invention, there is provided a mixed flow impeller which includes a hub portion of a generally truncated conical shape, and a plurality of blade members secured to a peripheral portion of said hub portion. Each of said blade members is arranged to be generally in a straight line shape as its leading edge portion as viewed in a direction of a rotary axis thereof, and has an approximately arcuate shape in a cross section at said leading edge portion, with a thickness larger than that of said blade member.

In another aspect of the present invention, the mixed flow impeller includes a hub portion of a generally truncated conical shape, and a plurality of blade members secured to a peripheral portion of said hub portion, with each of said blade members being arranged to be generally in a straight line shape at its leading edge portion as viewed in a direction of a rotary axis thereof, and being integrally formed at an outer side of its leading edge, with a triangular portion having a thickness generally equal to that of the blade member so that a base of said triangular portion closely adheres to said leading edge portion, while an apex thereof is located at a forward portion in a rotating direction of said blade member, and one side of said triangular portion generally extends along an external circumference of said impeller.

In a further aspect of the present invention, the mixed flow impeller comprises a hub portion of a generally truncated conical shape, and a plurality of blade members secured to a peripheral portion of said hub portion, wherein a curvature curve connecting the leading edge and trailing edge of each of said blade members is formed by a cubic curve, with a maximum curvature height of said blade member being located nearer the trailing edge than a central portion between said leading edge portion and trailing edge portion, and the maximum curvature height being generally equal to a maximum curvature height when the blade member is formed by an arc.

Furthermore, depending on necessity, the mixed flow impeller adopts combination of the constructions described so far to achieve the objects.

By the arrangements as described so far, the present invention is capable of realizing low noise through improvements on the air flow around the impeller without complicating aerodynamic design of the mixed flow impeller.

BRIEF DESCRIPTION OF THE DRAWINGS

These and other objects and features of the present invention will become clear from the following description taken in conjunction with the preferred embodiments thereof with reference to the accompanying drawings, in which:

FIG. 2(*b*) is a cross section on an enlarged scale, taken along the line II(b)—II(b) in FIG. 2(*a*) (already referred to);

DETAILED DESCRIPTION OF THE INVENTION

Figure 2A:
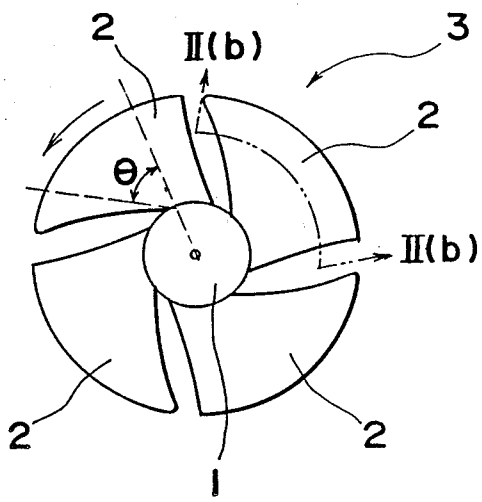
Fig. 2(a) PRIOR ART
FIG. 2(*a*) is a top plan view of the propeller fan shown in FIG. 1 (already referred to)
Figure 2B:
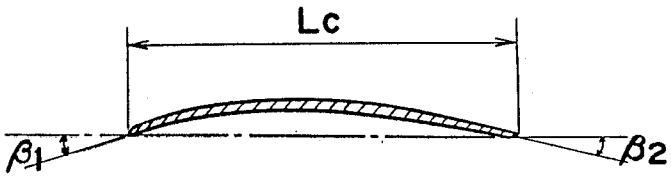
Fig. 2(b) PRIOR ART
Figure 1:
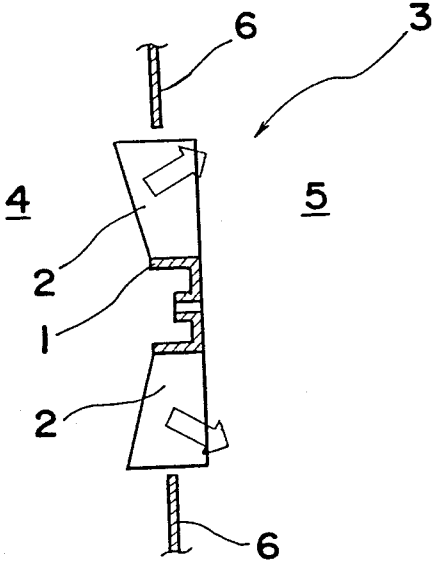
Fig. 1 PRIOR ART
FIG. 1 is a schematic side sectional view of a conventional propeller fan (already referred to)
Figure 4:
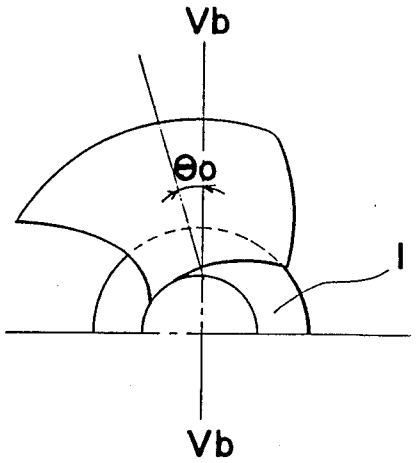
Fig. 4 PRIOR ART
FIG. 4 is a view similar to FIG. 3, which particularly shows an essential portion of a conventional mixed flow impeller having a tilting angle of $\theta_0$ (already referred to)
Figure 3:
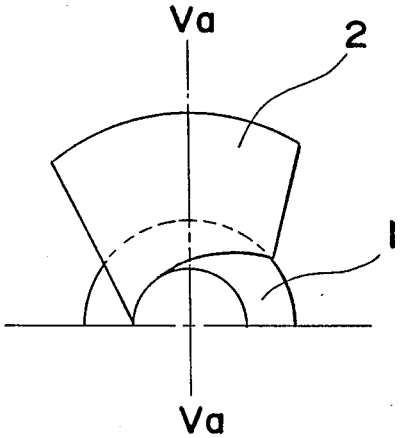
Fig. 3 PRIOR ART
FIG. 3 is a fragmentary top plan view showing an essential portion of a conventional mixed flow impeller (already referred to)
Figure 5:
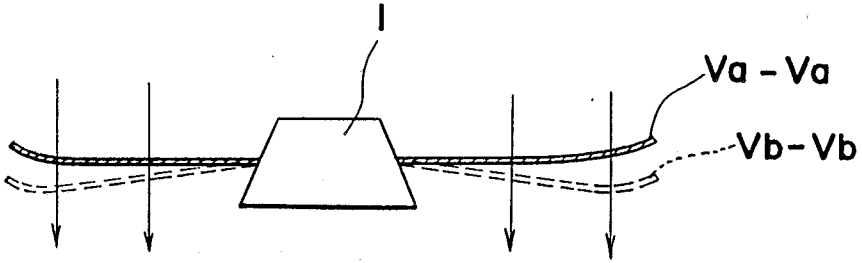
Fig. 5 PRIOR ART
FIG. 5 shows cross sections taken along the lines Va-Va in FIG. 3 and Vb—Vb in FIG. 4 (already referred to)

Before the description of the present invention proceeds, it is to be noted that like parts are designated by like reference numerals throughout the accompanying drawings.

Figure 6:
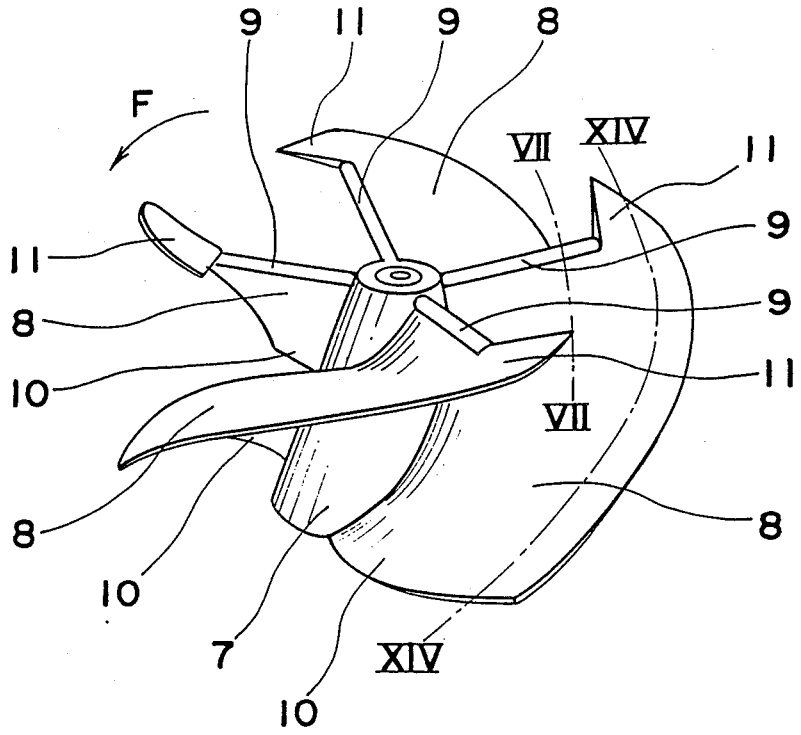
FIG. 6 is a perspective view of a mixed flow impeller according to one preferred embodiment of the present invention.

Referring now to the drawings, there is shown in FIG. 6, a mixed flow impeller according to one preferred embodiment of the present invention, which generally includes a hub or boss portion 7 in a truncated conical shape, and a plurality of blade members 8 secured to the outer peripheral portion of said hub portion 7, with each of the blade members 8 being formed with a leading edge 9, a trailing edge 10 and a triangular plate 11 provided at the leading edge 9 as illustrated, and said mixed flow impeller is arranged to be rotated in a direction indicated by an arrow F.

Figure 7:
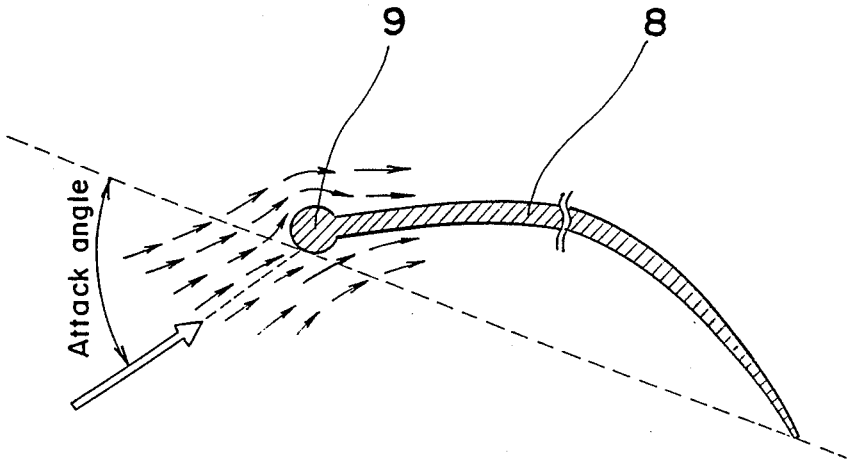
FIG. 7 is a cross section on an enlarged scale, taken along the line VII—VII in FIG. 6.

Referring also to FIG. 7, a side sectional shape at the leading edge 9 of each blade 8 will be described hereinbelow.

As shown in FIG. 7, the cross section of the blade 8 taken along the line VII—VII in FIG. 6 is formed, at its leading edge 9, with a thick portion generally of a circular arcuate configuration, and the thickness thereof should preferably be set at 1.5 to 3 times that of the blade 8. By forming the leading edge 9 into the thick arcuate shape as described above, air flows into the impeller along the curved face in the approximately arcuate shape even when the attack angle for the air stream flowing into the blade is varied to a certain extent, and thus, it becomes possible to suppress the separation of air flow in the vicinity of the leading edge. Therefore, turbulence of air flow on the blade surface is advantageously reduced, with a consequent reduction of turbulent flow vortex discharged from the trailing edge of the blade.

Figure 8:
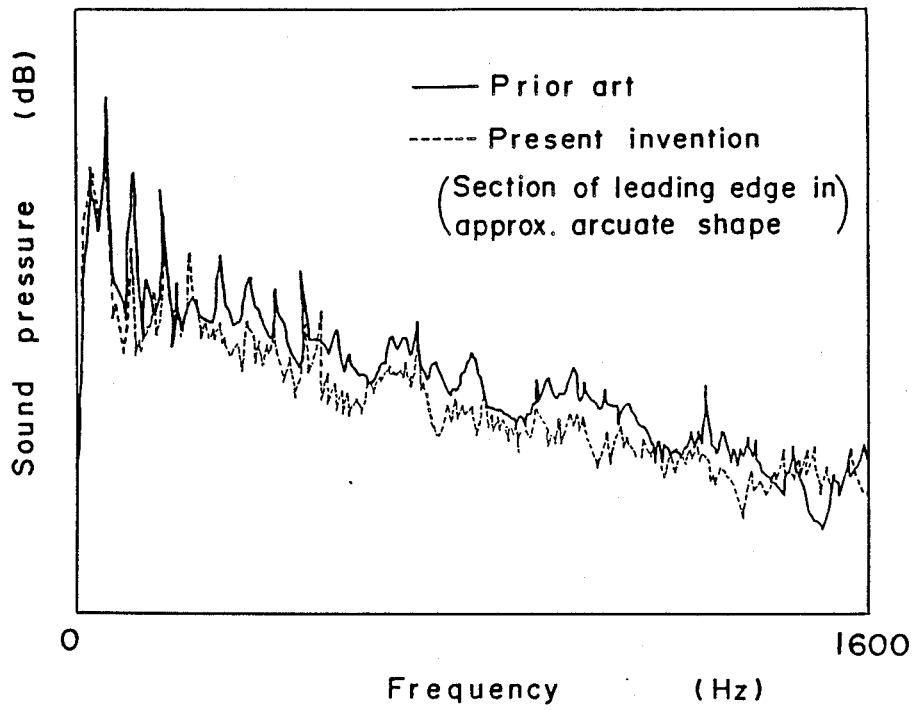
FIG. 8 is a characteristic diagram representing influence by the sectional shapes at a leading edge of the impeller of FIG. 6.

FIG. 8 is a diagram representing the effect for noise reduction available as a result of the above arrangement in the form of FFT (Fast Fourier Transform) analysis, and shows the relation between the frequency and sound pressure, with respect to the blade having the thick and generally arcuate cross sectional shape at the leading edge and the blade having a cross sectional shape of a uniform thickness, when the blower construction and air flow amount are set to be constant. From the graphical diagram of FIG. 8, it is seen that the blade having the cross sectional shape at the leading edge in generally the arcuate configuration has less noise.

Subsequently, the triangular plate 11 formed at the leading edge of the blade will be described hereinafter.

Figure 9:
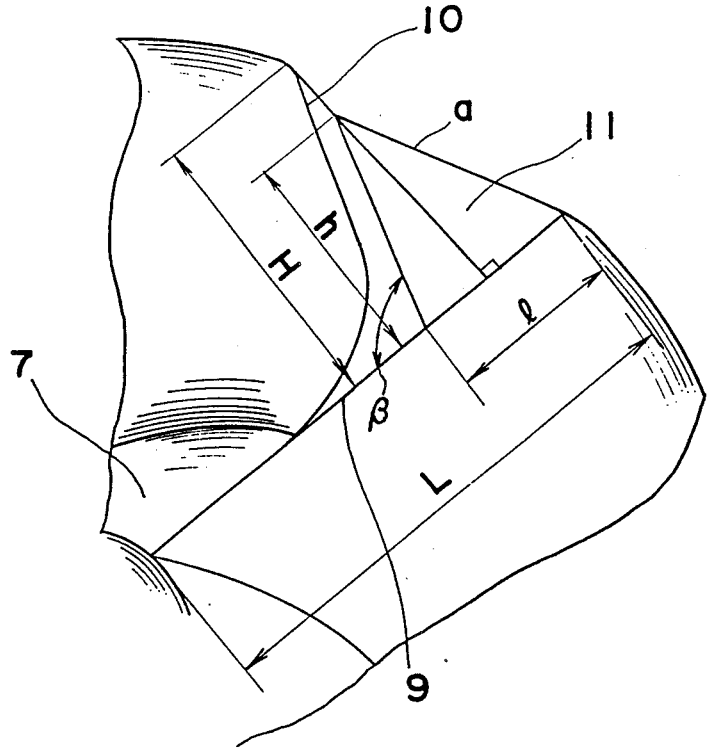
FIG. 9 is a fragmentary perspective view on an enlarged scale at the leading edge of the mixed flow impeller in FIG. 6.
Figure 10:
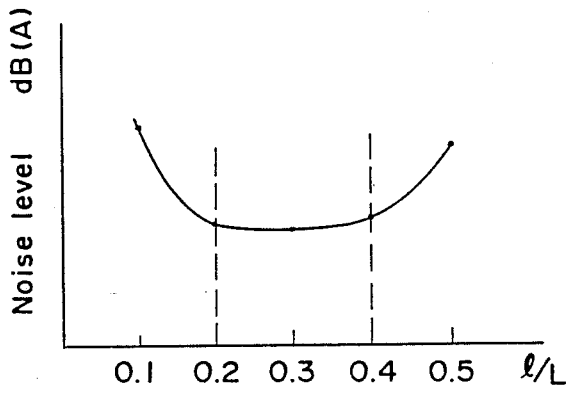
FIGS. 10, 11 and 12 are graphical characteristic diagrams showing noise characteristics with respect to main dimensional ratio of a triangular plate employed in the embodiment of FIG. 6.
Figure 11:
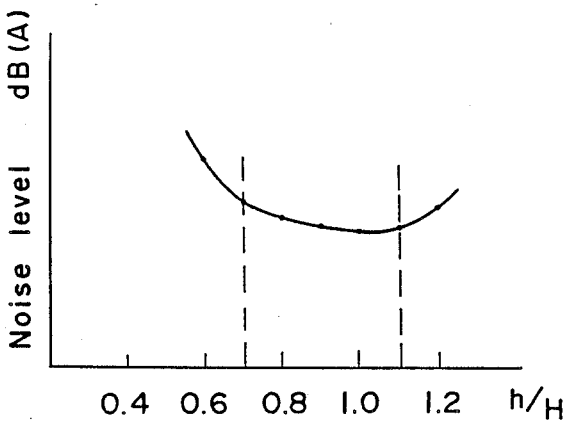
Figure 12:
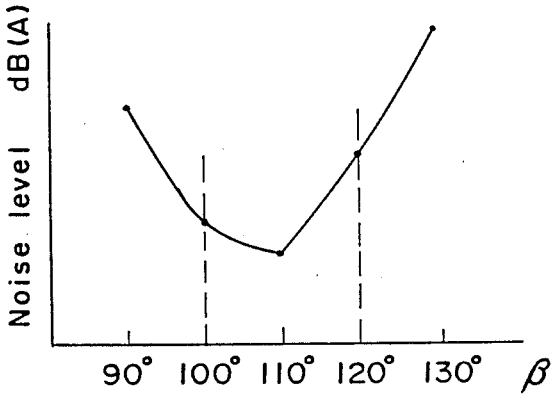

As shown in FIG. 9 on an enlarged scale, one side "a" of the triangular plate 11 is formed generally to extend along the external circumference of the impeller, and by optimizing the dimensions at respective portions of the triangular plate 11, it becomes possible to control the separation vortices generated at the end face of the triangular plate 11 for the improvement in the noise characteristics. FIGS. 10, 11 and 12 are graphs each showing the relation between the respective representative dimensional ratios of the triangular plate and noise characteristics when the functioning point is set to be constant, where l is a length of the base of the triangular plate 11, L shows a length at the leading edge of the blade, h denotes a height of the triangular plate 11, and H represents a distance in which the base line of the height h is extended up to the trailing edge of the blade. By the above graphs, it will be seen that the respective optimum dimensions are in the ranges at least $0.2 \leqq l/L \leqq 0.4$,, $0.7 \leqq h/H \leqq 1.1$ and $100° \leqq \beta \leqq 120°$.

Figure 13:
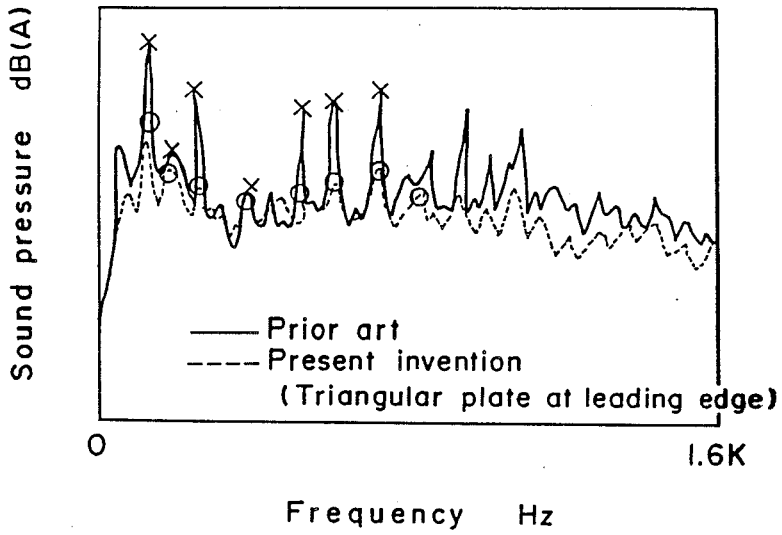
FIG. 13 is a characteristic diagram representing influence by the presence or absence of a triangular plate in the embodiment of FIG. 6.

As is seen from the foregoing description, according to the present embodiment, the noise reduction may be achieved by integrally forming the triangular plate corresponding to the tilting angle, with the leading edge of the respective blade for extrapolation in the rotating direction, after designing the fundamental blade shpae which satisfies the target performance. The effect by the presence or absence of such triangular plate is shown in a graphical diagram of FIG. 13 in the form of FFT analysis referred to earlier, which represents the relation between the sound pressure and frequency, with the presence or absence of the triangular plate being set as a parameter, when the air flow amount and dimensions at respective parts being held constant. In the above case, the impeller has an external diameter of 360 mm, with the parameters of the triangular plate being such that l=35mm, L=135mm, h=46mm, H=58mm and $\beta=115°$. From the graph of FIG. 13, it is seen that the blade with the triangular plate can provide more noise reduction as represented by dotted lines.

Subsequently, description will be given about the configuration of a blade curvature line which may largely affect the shape of the curved face of the blade.

Figure 14:
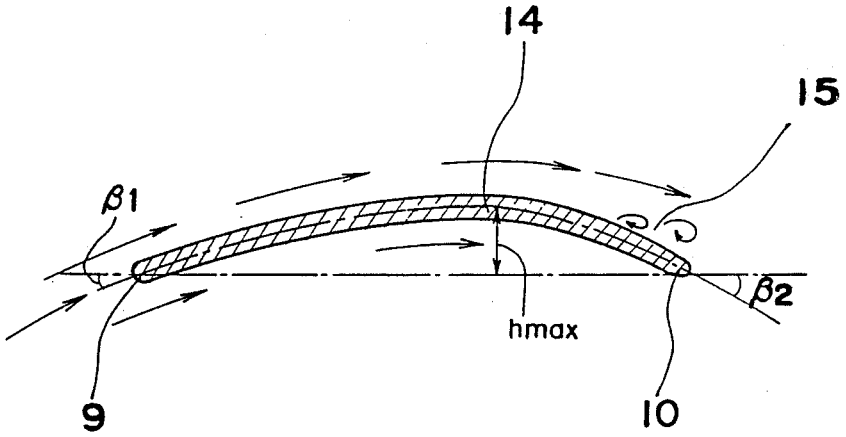
FIG. 14 is a cross section of the blade on an enlarged scale, showing a shape of a blade curvature line taken along the line XIV—XIV in the mixed flow impeller of the embodiment of FIG. 6.

FIG. 14 shows a cross section of the blade taken along the line XIV—XIV in FIG. 6.

Figure 17:
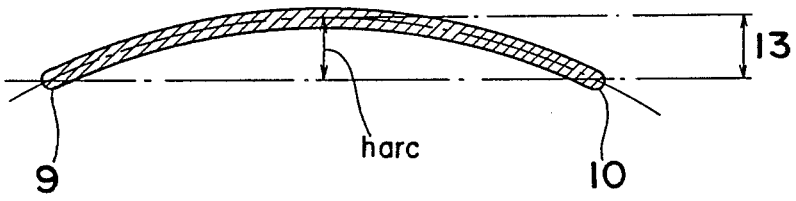
Fig. 17 PRIOR ART
FIG. 17 is a view similar to FIG. 14, which particularly shows a shape of a blade curvature line in a conventional mixed flow impeller.

In the conventional impeller, it has been a practice to form a blade curvature line connecting the leading edge and the trailing edge of the blade by a single arc, and therefore, the maximum curvature height $h_{arc}$ as at 13 where the curving of the blade becomes the highest with respect to a straight line connecting the leading edge 9 with the trailing edge 10 is located just at a central portion of the blade as shown in FIG. 17.

In the present embodiment, however, as shown in FIG. 14, since the position 14 where the curvature of the blade becomes the largest (maximum curvature height $h_{max}$) is formed at a portion closer to the trailing edge 10 than at the central portion 13 between the leading edge 9 and trailing edge 10 of the blade, the separation region 15 of air flow over the blade surface may be reduced to be smaller than in the conventional arrangement. More specifically, air stream flowing onto the blades is caused to flow along the upper and under surfaces of each blade so far as large separation is not produced at the leading edge, and over the upper surface of the blade, air flows with its speed increasing, and is reduced in its speed after passing through the portion in the vicinity of the maximum curvature height position 14 ($h_{max}$). Generally, since the reduced speed flow is of a pressure rising flow increasing in its pressure, separation tends to take place, and the air flow over the blade upper surface forms the separation region 15 at the portion closer to the trailing edge 10 from the neighborhood of the maximum curvature height position 14, thus resulting in the reduction of air moving performance and increase of noises.

In the impeller according to the present embodiment, owing to the arrangement that the maximum curvature height position 14 ($h_{max}$) is located closer to the trailing edge side than the central portion 13 between the leading and trailing edges 9 and 10 of the blade, the separating region 15 to be produced at the downstream side of the maximum curvature height position 14 becomes smaller, and the loss and noise due to the separation may be suppressed advantageously.

Figure 15:
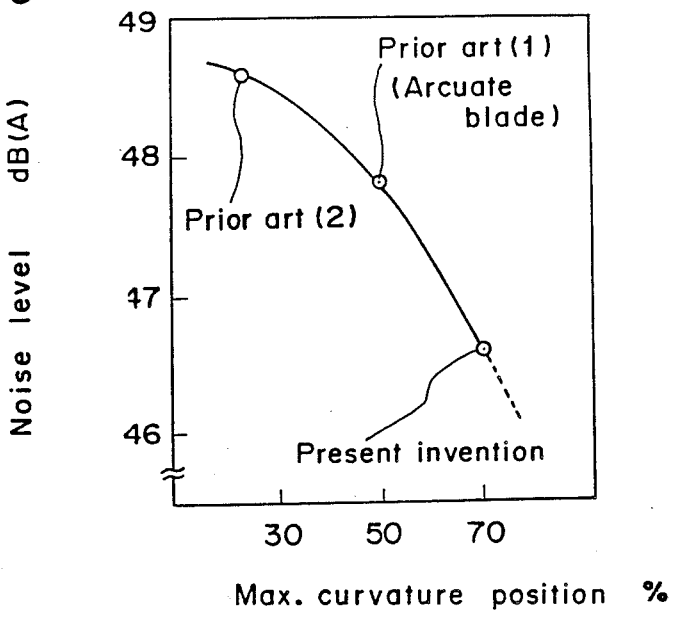
FIG. 15 is a characteristic diagram showing influence by the blade curvature line shape in the embodiment of FIG. 6.

FIG. 15 shows one example of comparison of the noise at the same air flow amount with the maximum curvature height position 14 for the blade curvature line as varied. The impeller used for the experiment was of a four blade type, with the external diameter of 360mm, height of 100mm, and revolutions at 900rpm, andprovided with no heat exchanger. The functioning point for comparison was at $23m^3$/min in the air flow amount, and at approximately 3.8mmAg in the static pressure for each case. From the graph of FIG. 15, it is seen that the lowest noise may be achieved when the maximum curvature height position 14 is located at the position closer to the trailing edge 10 from the portion at least 70% or thereabout from the leading edge 9.

Furthermore, according to the present embodiment, since a cubic curve is employed as the curve for connecting the leading edge 9, trailing edge 10, and the maximum curvature height position, it becomes possible to displace the maximum curvature height position, with the maximum curvature height $h_{max}$, entrance angle $\beta 1$ and exit angle $\beta 2$ being maintained to be the same as in the case of a single arc blade, and thus, only the blade curve can be varied without altering the dimensions and shape of the impeller on the whole.

As is clear from the foregoing description, according to the mixed flow impeller of the present invention, the effect for suppression of the air flow separation at the leading edge can be achieved by forming the cross section at the leading edge of the blade into the thick and approximately arcuate shape, and the turbulent noise may be advantageously reduced without forming the entire blade into the wing shape.

Moreover, by effecting the fundamental designing in the simple blade configuration in which the blade leading edge is formed generally into a straight line, and providing the triangular plate at the leading edge of each blade, with the shape and dimensions thereof optimized, the noise can be reduced, without deteriorating the fundamental performance.

Additionally, since the cubic curve is employed in the curvature line connecting the leading edge and trailing edge of the blade, with the maximum curvature height position being set at the position closer to the trailing edge than the central portion between the leading edge and the trailing edge, the separating region over the blade upper surface becomes smaller, and thus, the loss due to the separation and noise can be suppressed to the minimum.

Figure 16:
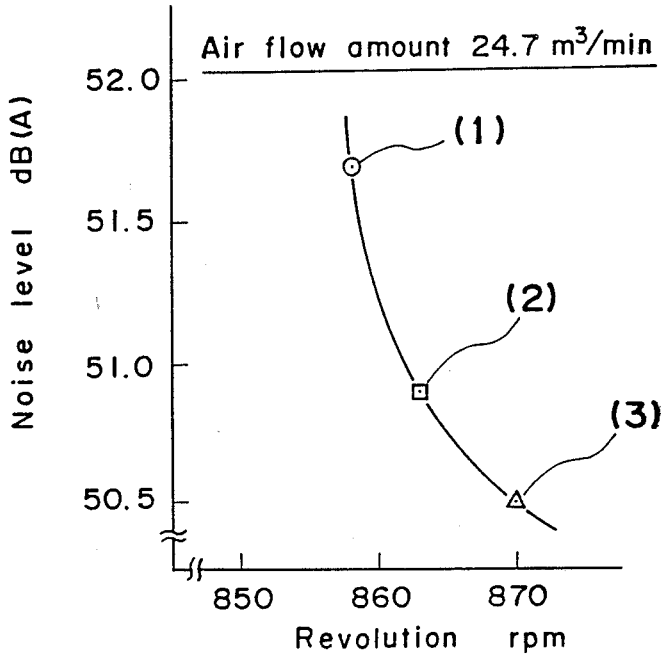
FIG. 16 is a characteristic diagram showing comparison between the embodiment of FIG. 6, and other embodiment.

It is to be noted here that the effects of the present invention as described above are independent of each other, but larger effects may be available if executed in combination rather than to be effected alone, one example of which is shown in a graphical diagram of FIG. 16 showing comparison of the revolutions at the same air flow amount and noise level. The impeller used for the experiment was of a four blade type, and had an external diameter of 360mm, and height of 120mm, with a heat exchanger being provided at a suction side. In FIG. 16, numeral (1) represented by a circle mark relates to a case where only the present invention in which the maximum curvature height position is set at the position closer to the trailing edge is effected, numeral (2) denoted by a square mark relates to a case where the leading edge of the blade is formed with the thick portion of approximately arcuate shape, and numeral (3) shown by a triangular mark relates to a case where the triangular plate is further provided at the leading edge of the blade. As is seen from the graph of FIG. 16, the effect for the noise reduction may be enlarged when the present invention is effected in combination.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A mixed flow impeller which comprises a hub portion of a generally truncated conical shape, and a plurality of blade members secured to a peripheral portion of said hub portion, each of said blade members being arranged to be generally in a straight line shape at its leading edge portion as viewed in a direction of a rotary axis thereof, and having an approximately arcuate shape in a cross section at said leading edge portion, with a thickness larger than that of said blade member.

2. A mixed flow impeller as claimed in claim 1, wherein each of said blade members is integrally formed, at an outer side of its leading edge, with a triangular portion having a thickness generally equal to that of the blade member so that a base of said triangular portion closely adheres to said leading edge portion, with an apex thereof being located at a forward portion in a rotating direction of said blade meber, and with one side of said triangular portion generally extending along an external circumference of said impeller.

3. A mixed flow impeller as claimed in claim 1, wherein a curvature curve connecting the leading edge and trailing edge of said blade member is formed by a cubic curve, with a maximum curvature height ($h_{max}$) of said blade member being located nearer the trailing edge than a central portion between said leading edge and trailing edge, and said maximum curvature height ($h_{max}$) being generally equal to a maximum curvature height ($h_{arc}$) when the blade member is formed by an arc.

4. A mixed flow impeller which comprises a hub portion of a generally truncated conical shape, and a plurality of blade members secured to a peripheral portion of said hub portion, each of said blade members being arranged to be generally in a straight line shape at its leading edge portion as viewed in a direction of a rotary axis thereof, and being integrally formed, at an outer side of its leading edge, with a triangular portion having a thickness generally equal to that of the blade-member so that a base of said triangular portion closely adheres to said leading edge portion, with an apex thereof being located at a forward portion in a rotating direction of said blade member, and with one side of said triangular portion generally extending along an external circumference of said impeller.

5. A mixed flow impeller as claimed in claim 4, wherein a curvature curve connecting the leading edge and trailing edge of said blade member is formed by a cubic curve, with a maximum curvature height ($h_{max}$) of said blade member being located nearer the trailing edge than a central portion between said leading edge and trailing edge, and said maximum curvature height ($h_{max}$) being generally equal to a maximum curvature height ($h_{arc}$) when the blade member is formed by an arc.

6. A mixed flow impeller as claimed in claim 4, wherein said triangular portion is formed by a triangular plate set in such relations as:

$$0.2 \leqq l/L \leqq 0.4$$

$$0.7 \leqq h/H \leqq 1.1$$

$$100° \leqq \beta \leqq 120°$$

where l is the length of the base closely adhering to the leading edge portion of the blade member, in the three sides of said triangular portion, h is the height of the triangular portion from said base, $\beta$ is an angle formed between the side located at the inner peripheral side of the impeller and said leading edge, H is a length of a perpendicular from an outer peripheral edge of the blade member trailing edge to the blade member leading edge located rearward in the rotating direction in a flat plan in which the impeller is observed in the direction of the rotary shaft, and L is a length of said blade member leading edge.

7. A mixed flow impeller which comprises a hub portion of a generally truncated conical shape, and a plurality of blade members secured to a peripheral portion of said hub portion, wherein a curvature curve connecting the leading edge and trailing edge of each of said blade members is formed by a cubic curve, with a maximum curvature height ($h_{max}$) of said blade member being located nearer the trailing edge than a central portion between said leading edge and trailing edge, and said maximum curvature height ($h_{max}$) being generally equal to a maximum curvature height ($h_{arc}$) when the blade member is formed by an arc.

8. A mixed flow impeller as claimed in claim 7, wherein each of said blade members is arranged to be generally in a straight line shape at its leading edge portion as viewed in a direction of a rotary axis thereof, and is integrally formed, at an outer side of its leading edge, with a triangular portion having a thickness generally equal to that of the blade member so that a base of said triangular portion closely adheres to said leading edge portion, with an apex thereof being located at a forward portion in a rotating direction of said blade member, and with one side of said triangular portion generally extending along an external circumference of said impeller, the portion of said blade member leading edge not formed with said triangular portion being formed into an approximately arcuate shape in a cross section with a thickness larger than that of said blade member.

* * * * *